United States Patent [19]

Warncke et al.

[11] 4,200,092

[45] Apr. 29, 1980

[54] RESPIRATOR HAVING AN OXYGEN-RELEASING CHEMICAL CARTRIDGE

[75] Inventors: Ernst Warncke, Lübeck; Adalbert Pasternack, Bad Schwartau, both of Fed. Rep. of Germany

[73] Assignee: Drägerwerk Aktiengesellschaft, Fed. Rep. of Germany

[21] Appl. No.: 870,833

[22] Filed: Jan. 19, 1978

[30] Foreign Application Priority Data

Jan. 20, 1977 [DE] Fed. Rep. of Germany ..... 2702193

[51] Int. Cl.[2] ..... A62B 7/00

[52] U.S. Cl. ..... 128/202.26; 55/DIG. 33

[58] Field of Search ..... 128/191 R, 142 R, 142.2, 128/142.3, 142.4, 142.5, 142.6, 142.7, 146.6, 147, 202, 188, 140 R, 203; 55/312, 418, DIG. 33, DIG. 35, 482, 286, 387

[56] References Cited

U.S. PATENT DOCUMENTS

| | | | |
|---|---|---|---|
| 2,956,562 | 10/1960 | Leffler, Jr. | 128/191 R |
| 3,326,212 | 6/1967 | Phillips | 128/202 X |
| 3,794,030 | 2/1974 | Cotabish et al. | 128/202 |
| 3,980,081 | 9/1976 | Cotabish et al. | 128/202 X |

FOREIGN PATENT DOCUMENTS

| | | | |
|---|---|---|---|
| 208565 | 4/1909 | Fed. Rep. of Germany | 128/191 R |

*Primary Examiner*—Henry J. Recla

*Attorney, Agent, or Firm*—McGlew and Tuttle

[57] ABSTRACT

The respirator comprises a first oxygen-liberating chemical cartridge housing which has a first end with a first opening and an opposite end with a second opening. The first cartridge has a tubular extension adjacent the second end communicating with the second opening and having a lateral air bag opening which opens into an air bag which surrounds the first cartridge. A breathing hose is connected from a mouthpiece which is adapted to be worn by a patient to the first opening of the first cartridge housing. The first cartridge housing also has a breathing tube connected to the second opening of the first cartridge housing and it may be coupled to a similar second breathing tube portion of a second cartridge housing. In addition, the second cartridge housing may be coupled to the air bag or the extension of the first cartridge housing so as to form an airtight seal therewith.

16 Claims, 21 Drawing Figures

RESPIRATOR HAVING AN OXYGEN-RELEASING CHEMICAL CARTRIDGE

FIELD AND BACKGROUND OF THE INVENTION

This invention relates to respirators in general and, in particular, to a new and useful respirator with an oxygen-releasing chemical cartridge.

DESCRIPTION OF THE PRIOR ART

In respirators with oxygen-releasing chemical cartridges on a basis of solid oxygen, the oxygen production occurs due to a reaction of the oxygen-containing chemical with the moisture and the carbon dioxide in the exhaled air, or it takes place spontaneously after ignition. With the chemical cartridge present in the apparatus, the time of use is limited. It can be extended by the coupling-in of a larger chemical cartridge.

A known oxygen respirator, which can be used with circulation of the respiratory air, as well as in swinging respiration, is equipped with a cartridge which contains the oxygen-releasing, carbon dioxide-binding material and which can be changed during use of the apparatus. The cartridge is provided in its sheath with an inlet aperture and opposite outlet aperture. It is mounted gas-tight in a bearing. After it is spent, it can be replaced by a new cartridge inserted directly behind it during uninterrupted use of the apparatus under hermetic seal of the coupling apertures. The bearing may consist of a tubular external container open at both ends or it may comprise two opposite bowl-type shells which are secured to a bearing plate. At least one of these is pressed elastically against the sheath of the cartridge.

In this respirator, the sealing of the cartridges in the long bearing, in which almost two cartridges must be received axially, one behind the other, is not easy. With the rough treatment for which such equipment are intended, it is bound to happen that the easy sliding in changing of the cartridges will be prevented by dirt. Moreover, there is no assurance that the cartridge in use will be fully utilized to the end. See German Pat. No. 650,830.

Another known oxygen respirator, functioning with circulating respiratory air, contains a replaceable air-purifying cartridge. The carbon dioxide is absorbed in a known manner in the air purifying cartridge, and oxygen is generated thereby. During operation with the air purifying cartridge connected, the respiratory air is conducted over the chemical in the cartridge into the breathing bag and is then inhaled again by a direct route. The air-purifying cartridge has air inlet and air outlet openings arranged concentrically to each other, whereby, it is connected into the respiration system via a sleeve coupling and a valve arrangement consisting of two spring-loaded, nested valve shutters. After removal of the cartridge, the sleeve coupling is sealed from the outside, whereas, the passage for exhalation from the wearer to the breathing bag is open. Despite the complicated design of the coupling with the valves, the replacement of the spent cartridges is a dangerous moment for the user, since during this time, he can only breathe from the breathing bag, the respiratory air content of which is exhausted after only a few breaths. Exchange of the air purifying cartridge must therefore be carefully prepared and must then still be made possible without difficulties. It is likely, that in emergency situations, problems may arise. See German Pat. No. 1,209,434.

SUMMARY OF THE INVENTION

The present invention permits the extending of the time of use of respirators with oxygen-releasing chemical cartridges by coupling a supplementary chemical cartridge, without jeopardizing the wearer by interruption of the supply of respiratory gas during the coupling.

The advantages obtained with this invention consist particularly in that the wearer is not burdened with a great weight during his normal activity, during which he only carries the respirator on his person but does not use it. For starting its use, the respirator has a small and, therefore, lightweight chemical cartridge, which provides full breathing protection, if only for a limited time. To extend the time of use, a larger supplementary chemical cartridge is then coupled to the smaller chemical cartridge, without endangering the wearer's breathing and thus his safety. The supplementary chemical cartridges are stored in places known to the wearer and are readily available there in the event a catastrophe arises. The technical design of the connection of the supplementary chemical cartridge to the respirator is simple and safe. The necessary two seals are effected without a complicated double fit. The ability to breathe is not interrupted during the coupling process. The supplementary chemical cartridge may be larger, so that the time of use can be prolonged for as long as is desired.

By equipping the respirator and the chemical cartridge additionally with check valves, different air conductions are made possible, which permit adaptations to respective needs in an advantageously simple manner. Among other things, a user, in whose area great differences in altitude must be overcome, may accept equipment rendered somewhat more complicated by valves, in order to get to a lower respiration resistance, or in order to be able to inhale air which has been cooled in the breathing bag.

In order to safely hold the supplementary chemical cartridge on the chemical cartridge of the respirator, simple solutions are provided. In any event, the chemical cartridge and the supplementary chemical cartridge are held together after the coupling by mechanical coupling elements which are subsequently releasable. In order to couple the supplementary chemical cartridge, the chemical cartridge must be opened. In a variation of the invention, the supplementary chemical cartridge has a separating device for opening the chemical cartridge at its pipe connection piece, which is closed by a foil.

To further simplify the retention and to increase the operational safety of the supplementary chemical cartridge, the cartridge has a chlorate starter connected with the mechanical coupling elements, and it includes a heat protection plate.

Accordingly, it is an object of the invention to provide a respirator device which includes an air tube for connection to a patient's mouth which is connected to a first cartridge housing containing a chemical for liberating oxygen which is connected to an air bag arranged adjacent the first cartridge housing and which also includes a second cartridge housing which is connectable to a breathing tube extension at the other end of the cartridge housing from the breathing hose and which may be coupled to the first cartridge housing or a tubular extension thereof for providing a respiratory gas flow which will be through the chemical of the first cartridge housing, and when that is used up or is insufficient, and when the second cartridge housing is connected to the first cartridge housing, will be through the second chemical in the second cartridge housing.

A further object of the invention is to provide a respirator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
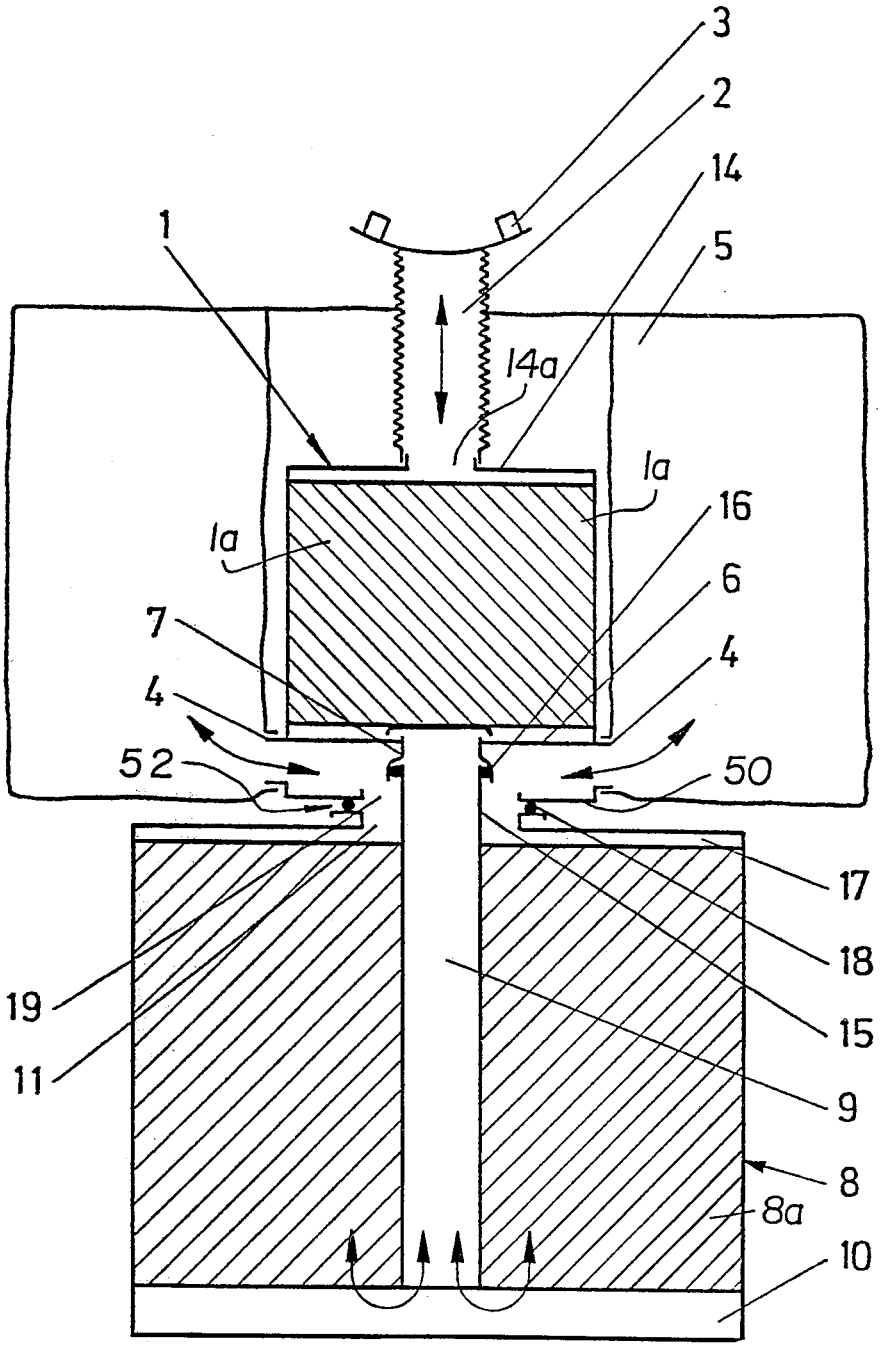
FIG. 1 is a somewhat schematic partial sectional view of a respirator having an oxygen-liberating chemical in a first cartridge housing and in an additional or supplemental cartridge housing which may be readily connected into the respiratory gas flow path.

Referring to the drawings in particular, the invention embodied therein in FIG. 1 comprises a respirator which is adapted to be connected to a patient (not shown) by a mouthpiece 3 which is insertable into the patient's mouth. Mouthpiece 3 is connected to a breathing hose 2 which has an opposite end which is connected to a first end opening 14*a* of a breathing connection 14 which, in the embodiment of FIG. 1, forms part of a first chemical cartridge housing, generally designated 1, which includes a chemical filling 1*a* therein of a chemical which, upon actuation, will liberate oxygen into the breathing gas flow.

The respirator according to FIGS. 1 to 4 comprises a carbon dioxide-binding and oxygen-releasing chemical 1*a* in a cartridge 1, to which a breathing hose 2 with a mouthpiece 3 is connected through a breathing connection 14. The lower end of the chemical cartridge 1 has adapters 4 communicating with the interior of a breathing bag 5.

A sleeve 7, into which a connecting piece or coupling end 15 of tube 9 of the supplementary chemical cartridge 8 is introduced for connection, is connected through an opening in a bottom 6. Sealing occurs through a seal ring 16. In addition, a cavity 17 above a chemical 8*a* of the supplementary chemical cartridge 8 is connected with the breathing bag 5 through a concentric opening 11 of the cartridge 8 and a counter-opening 19 in bottom extension 50 connected into the bag 5. Coupling means 52 permits quick connection between cartridge 8 and the extension 50, and it includes a seal 18.

In the applied state of the respirator in FIG. 1, the user exhales through the breathing hose 2. The exhaled air then flows through the chemical cartridge 1 and through sleeve 7 into tube 9 of the supplementary chemical cartridge 8. It is then distributed over an intermediate space 10 below the chemical 8*a* and flows through the chemical 8*a* of supplementary chemical cartridge 8 and central opening 11 into breathing bag 5. During inhalation through the hose 2, the reverse sequence is run through.

Figure 2:
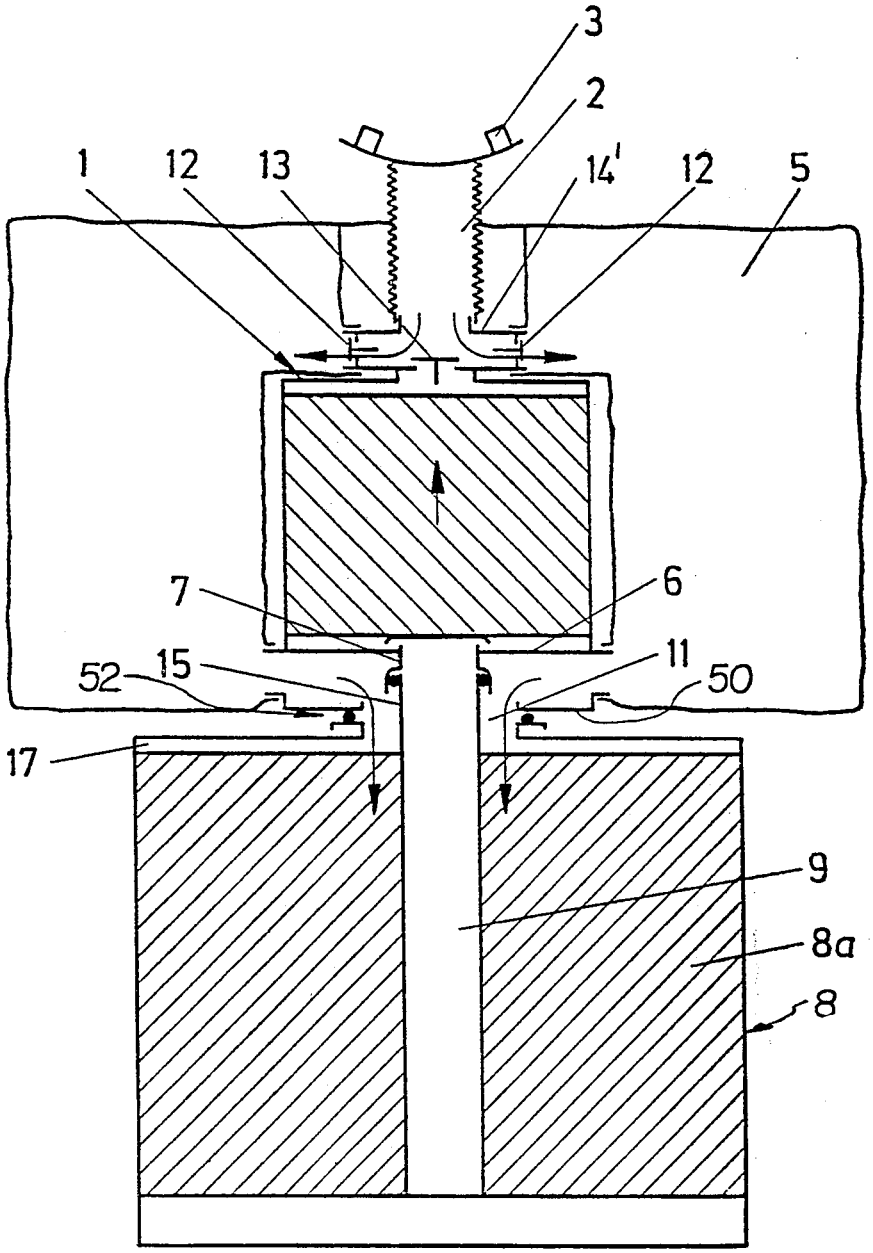
FIG. 2 is a view similar to FIG. 1 of another embodiment of the invention.

In the embodiment shown in FIG. 2, similar parts are similarly designated. The wearer exhales through the mouthpiece 3 and the breathing hose 2 via the check valves 12 in a breathing connection 14' and into the breathing bag 5. During inhalation, the respiratory air flows out of breathing bag 5 via the cavity 17 into the supplementary chemical cartridge 8 and leaves the cartridge 8 through tube 9, which is hermetically connected through the connecting piece 15 with the sleeve 7 in the bottom 6 of the chemical cartridge 1. After traversing the chemical cartridge 1 and a check valve 13 in the breathing connection 14', the respiratory air reaches the wearer's respiratory tracts via the breathing hose 2 and mouthpiece 3.

Figure 3:
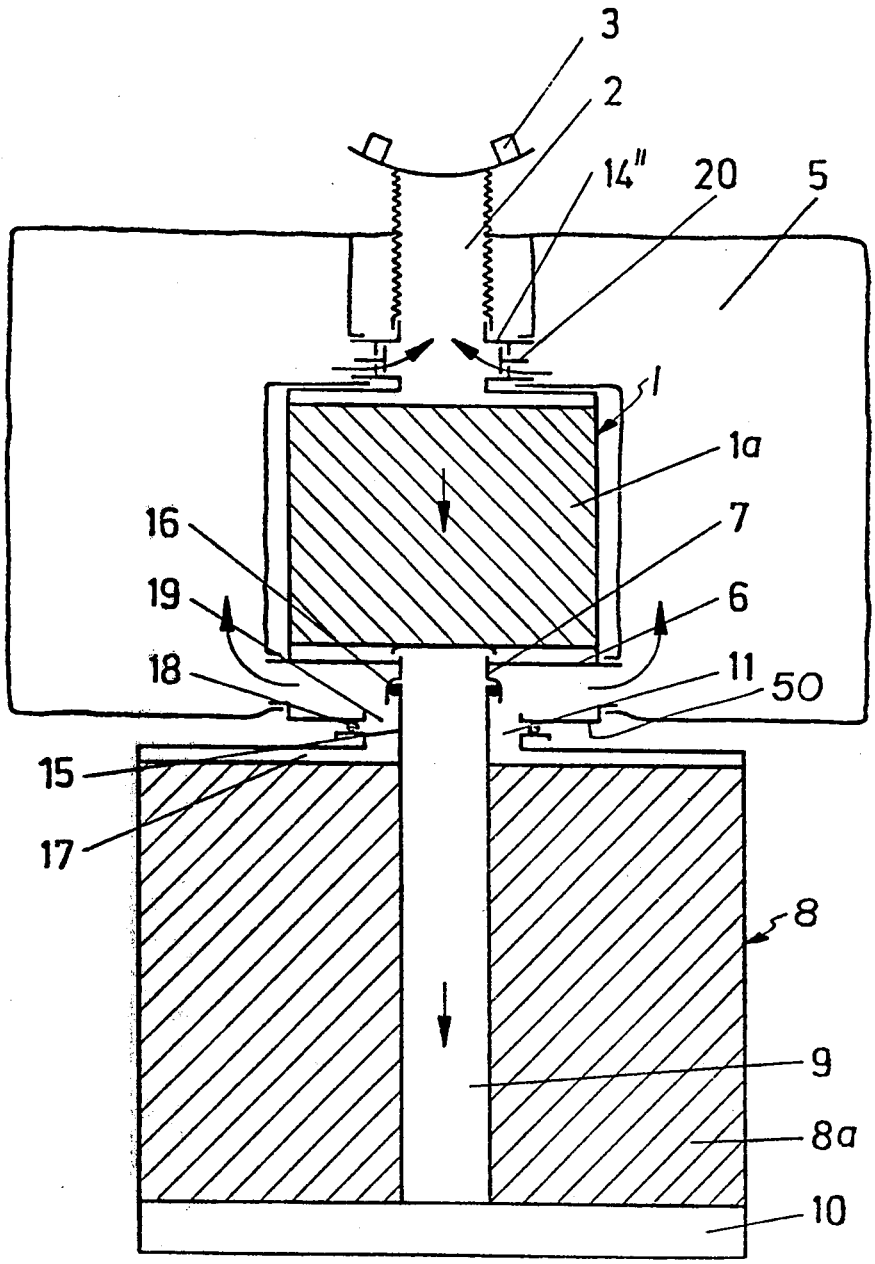
FIG. 3 is a view similar to FIG. 1 of still another embodiment of the invention.

According to FIG. 3, where similar parts are also similarly designated, the exhaled air flows via mouthpiece 3, breathing hose 2, chemical cartridge 1, sleeve 7, tube 9, supplementary chemical cartridge 8 and central opening 11 into the breathing bag 5. During inhalation, the respiratory air passes from the breathing bag 5 via the check valves 20 of a breathing connection 14'', breathing hose 2, and mouthpiece 3 into the wearer's respiratory tracts.

Figure 4:
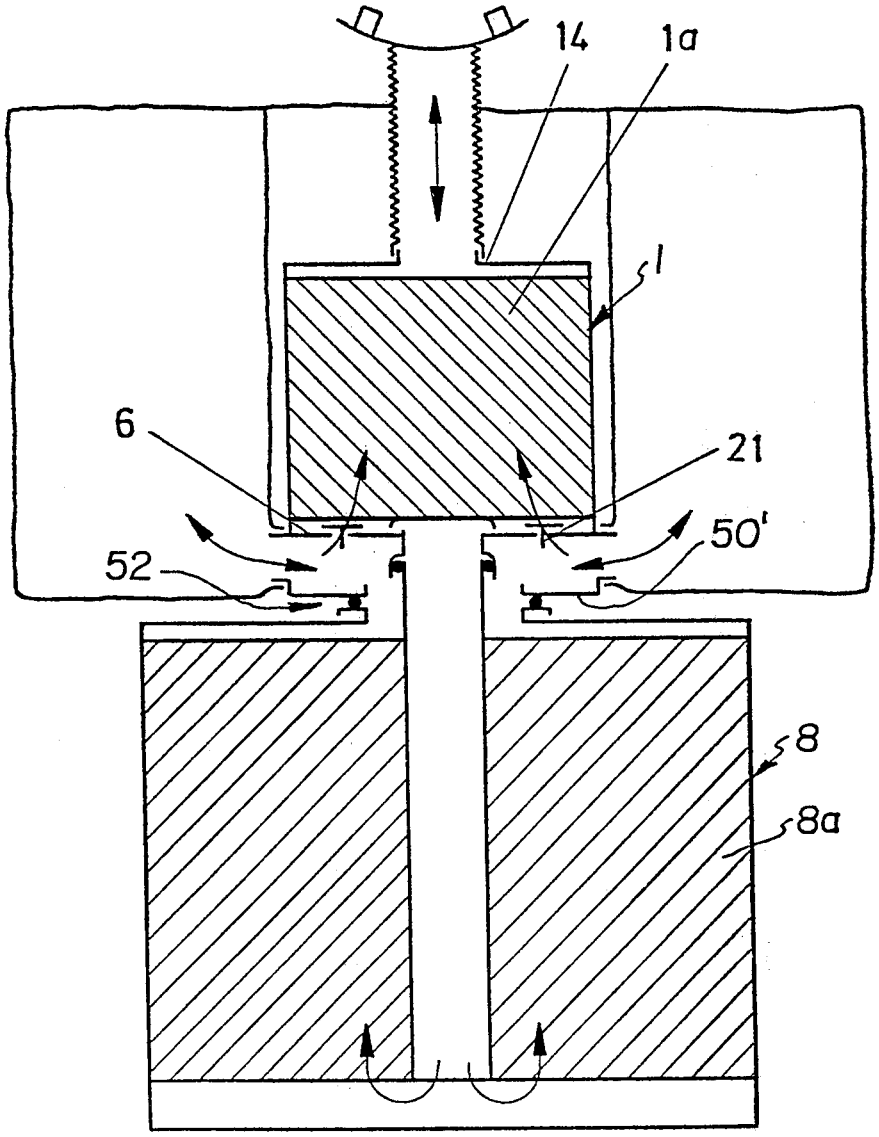
FIG. 4 is a view similar to FIG. 1 of yet another embodiment of the invention.

The embodiment according to FIG. 4 is more favorable in terms of respiration physiology than the design according to FIG. 1 since, due to the check valves 21 provided in a bottom extension 50'' of the bottom 6 of the chemical cartridge 1, in the inhalation phase, only the resistance of the chemical cartridge 1 must be overcome.

Figure 5A:
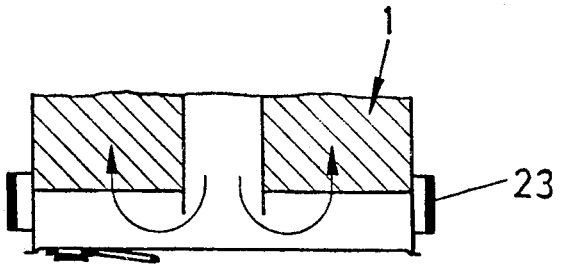
FIGS. 5*a*, 5*b*, and 5*c*; 6*a*, 6*b* and 6*c*; 7*a*, 7*b* and 7 *c*; and 8*a*, 8*b* and 8*c*, are enlarged, partial sectional views of each chemical cartridge housing and the coupling mechanism for coupling them together of the various embodiments of the invention.
Figure 5B:
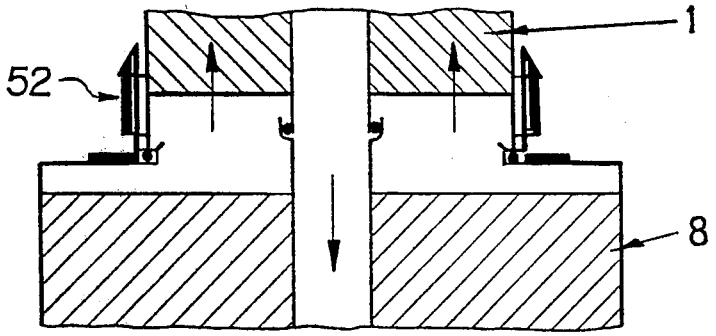

After coupling, the supplementary chemical cartridge 8 is retained at the chemical cartridge 1 by mechanical coupling elements 52. The embodiments of the coupling elements 52 are shown in FIGS. 5 to 9 are to convey an impression of the multiplicity of the technical possibilities. In these Figures, FIG. 5*a* shows the lower portion of the chemical cartridge 1; FIG. 5*b* shows the coupling of the chemical cartridge 1 with the supplementary chemical cartridge 8; and FIG. 5*c* shows the upper portion of the supplementary chemical cartridge 8.

The two cartridges 1 and 8 are closed gastight before use. Closing is effected, for example, through known tearing closures, which are not described herein.

Figure 5C:
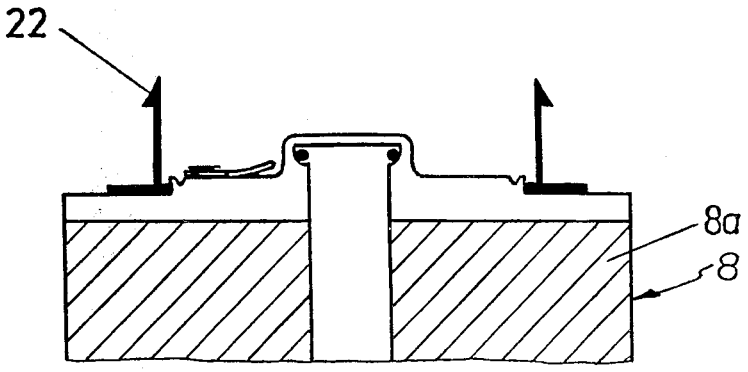

FIGS. 5*a*, 5*b* and 5*c* show a snap connection, comprising snaps or resilient male elements 22 at the supplementary chemical cartridge 8 and the eyes or receiving female parts 23 at the chemical cartridge 1.

Figure 6A:
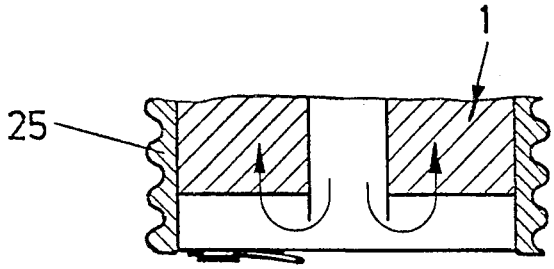
Figure 6B:
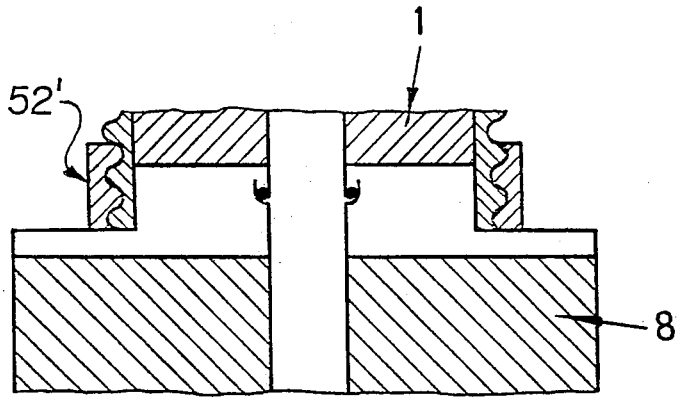
Figure 6C:
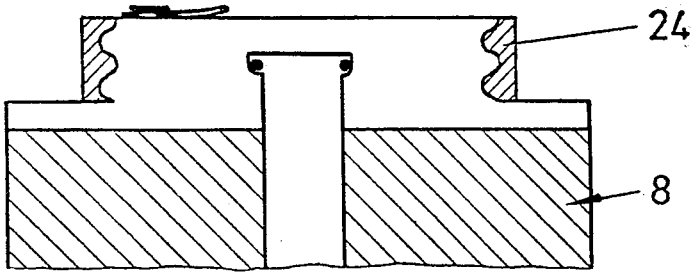

According to FIGS. 6*a*, 6*b* and 6*c*, the connection or coupling 52' is effected through threaded portions with the female thread 24 at the supplementary chemical cartridge 8 and the male thread 25 at the chemical cartridge 1.

Figure 7A:
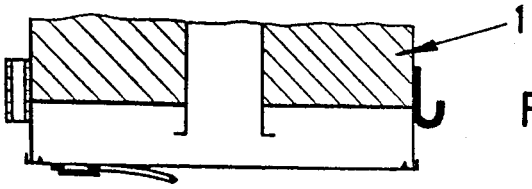
Figure 7B:
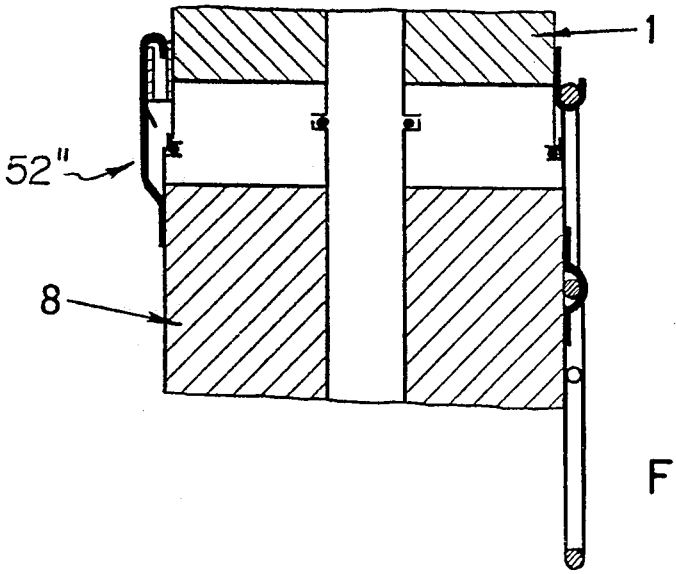
Figure 7C:
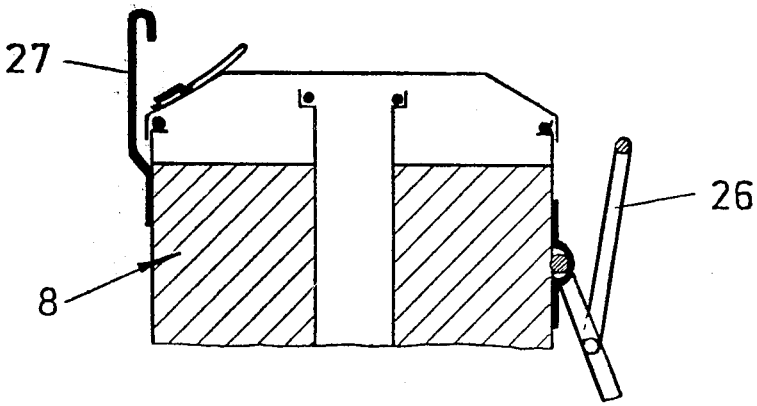
Figure 8A:
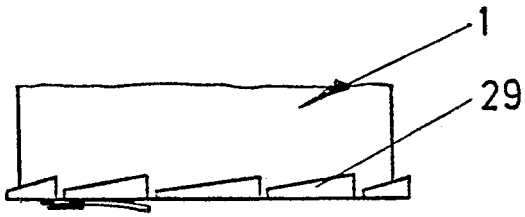
Figure 8B:
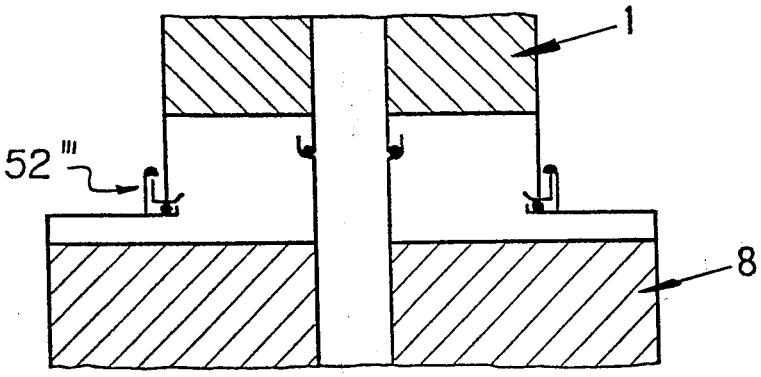
Figure 8C:
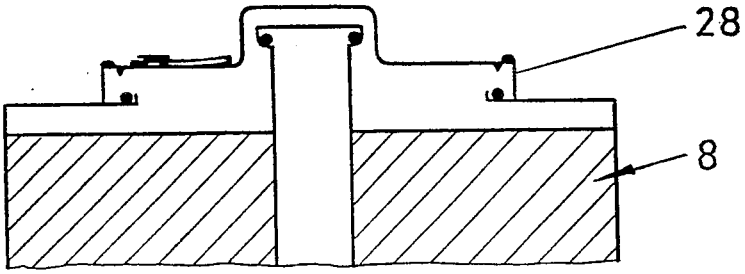

FIGS. 7*a*, 7*b* and 7*c* show a connection 52'' comprising a turnbuckle 26 and hook 27; and FIGS. 8*a*, 8*b* and 8*c* shows a connection 52''' comprising a clamping ring 28 with engaging inclined planes 29.

Figure 9A:
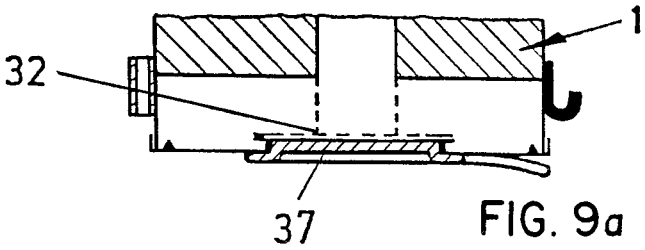
FIGS. 9*a*, 9*b* and 9*c* are partial sectional views showing the first chemical cartridge housing, the couple connection between the first and second chemical cartridge housings and the second cartridge housing for indicating the coupling elements thereof for coupling the breathing tube portions together.
Figure 9B:
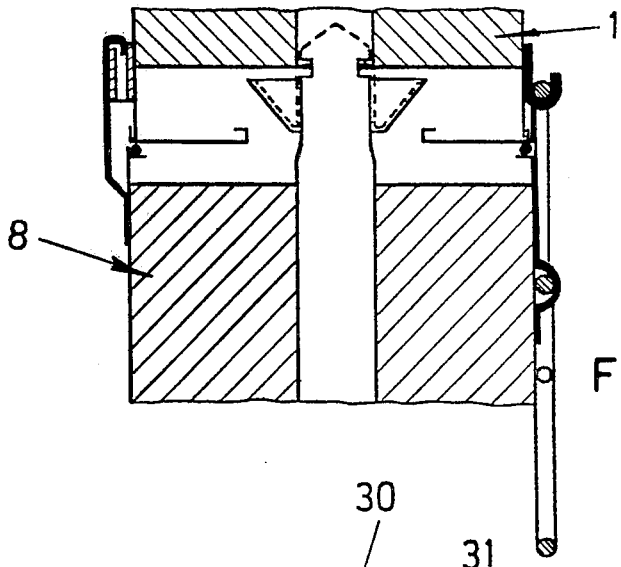
Figure 9C:
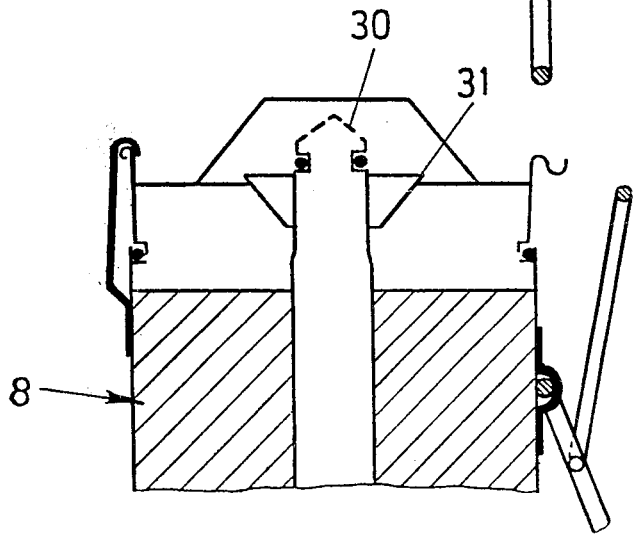

According to FIGS. 9*a*, 9*b* and 9*c*, in addition to coupling connection 52''', a pipe connection 30 of the supplementary chemical cartridge 8 is equipped with the separating device 31 which, upon coupling, opens the chemical cartridge 1, which is then still closed by a foil 32. The plug or cap 37 is removed first.

Figure 10A:
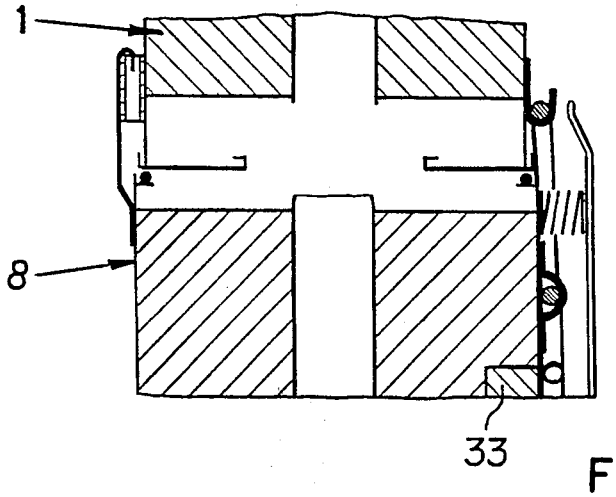
FIGS. 10*a* and 10*b* are enlarged partial sectional views indicating a secondary chemical cartridge with a chlorate starter and a heat protection plate associated therewith.
Figure 10B:
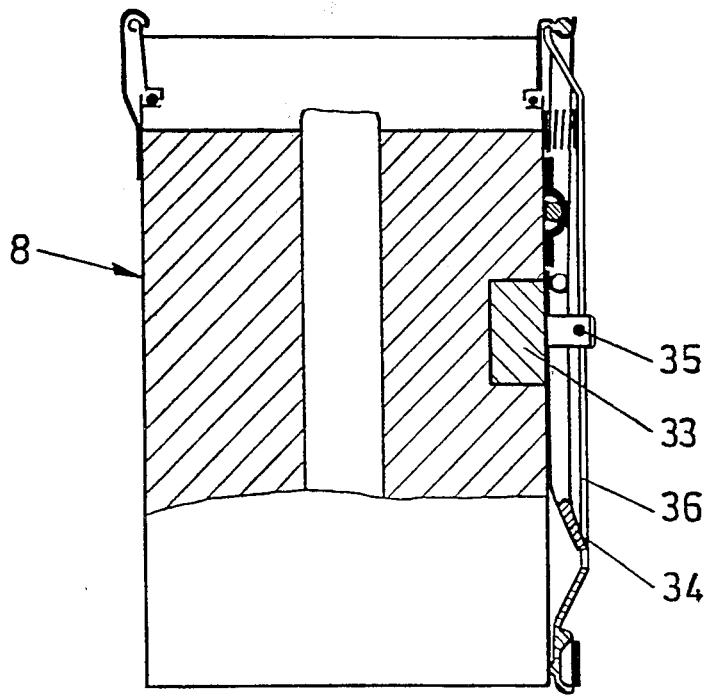

The supplementary chemical cartridge 8 may be equipped with a chlorate starter 33, as illustrated in FIGS. 10*a* and 10*b*. The starter 33 is ignited through the movement of a turnbuckle 34, during which the safety stud 35 is broken off. It then generates oxygen immediately, which prevents extraneous gases from penetrating into the opened supplementary chemical cartridge 8. At the same time, the heat protection plate 36 is extended so that it prevents burning of the skin.

While specific embodiments of the invention have been shown and described in detail to illustrate the application of the principles of the invention, it will be understood that the invention may be embodied otherwise without departing from such principles.

What is claimed is:

1. A respirator comprising a first cartridge housing having a first end with a first opening therein and a second end with a second opening therein; an oxygen-liberating chemical in said first housing spaced inwardly from each of said ends to form, with said first and second ends, respectively, first and second chambers, said chemical further comprising a gas-permeable barrier separating said first and second chambers; a breathing hose, one end of which is connected to said first opening to permit communication with said first chamber; an auxiliary cartridge housing comprising first and second walls; an oxygen-liberating chemical in said auxiliary cartridge housing spaced from each of said first and second walls and forming, with said first and second walls, respectively, third and fourth chamber, said oxygen-liberating chemical in said auxiliary cartridge housing further comprising a gas-permeable barrier between said third and fourth chambers; an air bag, and releaseable coupling means connecting said auxiliary cartridge housing to said first cartridge housing, said releaseable coupling means comprising first tubular means connecting said second chamber in said first housing to said third chamber in said second housing, and second tubular means concentric with said first tubular means and connecting said air bag to said fourth chamber.

2. A respirator, as claimed in claim 1, including a breathing connection between said breathing hose and said first opening of said first cartridge housing, said breathing connection including at least one connection into said air bag with a first check valve means for permitting flow from said air breathing hose in a direction into said air bag and second check valve means permitting flow from said first opening of said cartridge out of said cartridge into said breathing hose.

3. A respirator, as claimed in claim 1, including a breathing connection between said breathing hose and said first opening of said first cartridge housing, with first check valve means permitting flow from the breathing bag into said breathing hose.

4. A respirator, as claimed in claim 1, wherein said coupling means coupling said first cartridge housing and said second cartridge housing together comprises a mechanical coupling comprising a male element on one of said housings and a female element on the other of said housings into which the male element is engaged.

5. A respirator, as claimed in claim 4, including a resilient male member having a hook end, said female part comprising a receiving eyelet into which said resilient male member engages.

6. A respirator, as claimed in claim 1, wherein said coupling means includes a male member in the form of a hook on one of said housings and a female member in the form of an eyelet into which said hook engages on the other of said housings, and further including a turnbuckle having one end pivoted to one of said parts and an opposite end engageable in a recess in the other of said parts and being pivotal to urge said parts together.

7. A respirator, as claimed in claim 1, wherein said coupling means includes coupling elements, including a clamping ring on one of said cartridge housings and an inclined plane on the other of said cartridge housings, said inclined plane being engaged under said clamping ring and being rotatable with said associated housing to cause a wedging interengagement therebetween.

8. A respirator, as claimed in claim 1, wherein said first breathing tube is closed by a foil, said second breathing tube having means at the end thereof for penetrating the foil to open the respirator flow passage therethrough upon connection of said second cartridge housing to said first cartridge housing.

9. A respirator, as claimed in claim 1, including a chlorate starter connected to said second housing, chemical and mechanical means connected to said starter for initiating said starter including a heat protection plate which is extendable outwardly from said second cartridge housing to protect the operator against heat.

10. A respirator as claimed in claim 1, comprising: a breathing connection connecting said breathing hose to said first chamber; and a transverse passage in said breathing connection for respirator air flow to each side of said breathing connection, said air bag being arranged around said first cartridge housing and having a communication with each end of said transverse passage.

11. A respirator, as claimed in claim 1, comprising: check bag means connecting said air valve to said second chamber and comprising a movable member to permit gas flow only from said air bag into said second chamber.

12. A respirator, as claimed in claim 1, wherein said first tubular means comprises a first tubular coupling part connected to said second end of said first cartridge housing and comprising a flange, a second tubular coupling part having one end connected to said third chamber in said auxiliary cartridge housing and having a second end fitting into said flange, and an annular seal between said first and second coupling parts.

13. A respirator, as claimed in claim 1, wherein said first and second ends are at the top and bottom, respectively, of said first cartridge housing, said auxiliary cartridge housing is below said first cartridge housing and said first and second walls are at the bottom and top, respectively, of said auxiliary cartridge housing, said air bag comprises a bag extending around the periphery of said first cartridge housing and attached to said second end around said second opening, said first tubular means comprises a first portion extending downwardly from the bottom of said first cartridge housing and a second portion extending upwardly from the top of said third chamber through the oxygen-liberating chemical in said auxiliary cartridge housing, said coupling means being defined between said first and second portions of said first tubular means for exhalation of breathing gas along a path that passes through said breathing hose and downwardly, in succession, through said first chamber, said chemical in said first cartridge housing, said second chamber, said first tubular means, and said third chamber, and then upwardly, in succession, through said chemical in said auxiliary housing, said fourth chamber, and said second tubular means into said air bag, the flow of breathing gas upon inhalation being in the reverse manner.

14. A respirator, as claimed in claim 1, wherein said first and second ends are at the top and bottom, respectively, of said first cartridge housing, said auxiliary cartridge housing is below said first cartridge housing, and said first and second walls are at the bottom and the top, respectively, of said auxiliary cartridge housing, said air bag comprises a bag extending around the periphery of said first cartridge housing and attached to said first end around said first opening and to said second end around said second opening, said first tubular means comprises a first portion extending downwardly from the bottom of said first cartridge housing and a second portion extending upwardly from the top of said third chamber through the oxygen liberating chemical in said auxiliary cartridge housing, said coupling means being defined between said first and second portions of said first tubular means; first check valve means providing a one-way gas passage from said breathing hose into the part of said air bag adjacent to said first opening; and second check valve means between said first end and said breathing hose to permit breathing gas to pass only from said first chamber into said breathing hose, said respirator providing an exhalation path from said breathing hose through said first check valve means into said air bag, and an inhalation path from said air bag downwardly through said second tubular means, said fourth chamber and said chemical in said auxiliary cartridge housing and into said third chamber, and then upwardly through said first tubular means, said second chamber, said chemical in said first cartridge housing, said first chamber, and said second check valve means into said breathing hose.

15. A respirator, as claimed in claim 1, wherein said first and second ends are at the top and bottom, respectively, of said first cartridge housing, said auxiliary cartridge housing is below said first cartridge housing and said first and second walls are at the bottom and top, respectively, of said auxiliary cartridge housing, said air bag comprises a bag extending around the periphery of said first cartridge housing and attached to said second end around said second opening and to said first end around said first opening, said first tubular means comprises a first portion extending downwardly from the bottom of said first cartridge housing and a second portion extending upwardly from the top of said third chamber through the oxygen-liberating chemical in said auxiliary cartridge housing, said coupling means being defined between said first and second portion of said first tubular means; and check valve means connecting the part of said air bag adjacent said first end to said breathing hose to permit breathing gas to flow only from said air bag into said breathing hose, said respirator defining an exhalation gas passage from said breathing hose downwardly, in succession, through said first chamber, said chemical in said first auxiliary housing, said second chamber, and said first tubular means into said third chamber, and upwardly, in succession, through said chemical in said auxiliary cartridge housing, said fourth chamber, and said second tubular means into said air bag, and an inhalation path from said air bag through said check valve means into said breathing hose.

16. A respirator, as claimed in claim 1, wherein said first and second ends are at the top and bottom, respectively, of said first cartridge housing, said auxiliary cartridge housing is below said first cartridge housing and said first and second walls are at the bottom and top, respectively, of said auxiliary cartridge housing, said air bag comprises a bag extending around the periphery of said first cartridge housing and attached to and around said second opening, said respirator further comprising check valve means through said second end and connecting said air bag to said second chamber to permit the passage of gas only from said air bag into said second chamber, said first tubular means comprises a first portion extending downwardly from the bottom of said first cartridge housing and a second portion extending upwardly from the top of said third chamber through the oxygen-liberating chemical in said auxiliary cartridge housing, said coupling means being defined between said first and second portions of said first tubular means, said respirator having an exhalation air path from said breathing hose downwardly, in succession through said first chamber, said chemical in said first cartridge housing, said second chamber, and said first tubular means into said third chamber, and upwardly, in succession, from said third chamber through said chemical in said auxiliary cartridge housing, said fourth chamber, and said second tubular means into said air bag, and an inhalation air path from said air bag through said check valve means and said second chamber and upwardly through said chemical in said first cartridge housing and through said first chamber into said breathing hose.

* * * * *